United States Patent [19]

Glickson et al.

[11] Patent Number: 4,488,373

[45] Date of Patent: Dec. 18, 1984

[54] STACKABLE PIECE PLAYSET

[75] Inventors: David A. Glickson, Evanston; Harry Disko, S. Barrington, both of Ill.

[73] Assignee: Marvin Glass & Associates, Chicago, Ill.

[21] Appl. No.: 567,733

[22] Filed: Jan. 3, 1984

[51] Int. Cl.[3] ..... A63H 33/00

[52] U.S. Cl. ..... 446/4

[58] Field of Search ..... 46/17, 16, 1 R, 116, 46/119, 12

[56] References Cited

U.S. PATENT DOCUMENTS

| | | | |
|---|---|---|---|
| 710,560 | 10/1902 | Bonn | 46/17 |
| 2,617,654 | 11/1952 | Nolan et al. | 46/17 X |
| 3,836,418 | 9/1974 | Montgomery | 46/1 R X |

FOREIGN PATENT DOCUMENTS

| | | | |
|---|---|---|---|
| 580314 | 9/1946 | United Kingdom | 46/119 |
| 992454 | 5/1965 | United Kingdom | 46/17 |

*Primary Examiner*—Mickey Yu

*Attorney, Agent, or Firm*—John S. Pacocha

[57] ABSTRACT

A playset includes a series of pieces sequentially stackable on a hollow base and interconnected by a flexible tether. One end of the tether is secured to an end piece and the other, free end passes through the base and is connected to a tab. When a child pulls the tab the pieces are stacked on the base to form a tower. A plunger mounted on the outside of the base is depressable to move a lever mounted in the base upwardly to topple the stacked pieces.

4 Claims, 4 Drawing Figures

STACKABLE PIECE PLAYSET

BACKGROUND OF THE INVENTION

1. Field of the Invention

This invention relates generally to preschool playsets and more particularly to a playset facilitating the stacking and toppling of pieces.

2. Background Art

The stacking of blocks or other geometrically or thematically related pieces has bong provided preschool children with entertaining and educational activity. A disadvantage of such playsets involving loose pieces is that very young children do not have sufficient coordination and dexterity to stack the pieces. In addition, some of the loose pieces may become lost. One prior art solution is to tether or string pieces together in a preselected sequence with one end of the string secured to an end piece and passing loosely through the other pieces such that pulling on the other, free end stacks the pieces together in the prearranged sequence. While such stacking of pieces or blocks affords children with some entertainment, it is well recognized that knocking or toppling over the stack also is enjoyable to children. Accordingly, there remains a need for a playset that not only facilitates the stacking of pieces in a particular sequential manner, but also provides an entertaining method of toppling the stacked pieces.

SUMMARY OF THE INVENTION

The present invention is concerned with providing a preschool playset in which a series of sequentially stackable pieces are tethered together to facilitate proper stacking of the pieces upon a base and also provides an entertaining method of toppling the stacked pieces. These and other objects and advantages of the invention are achieved by a number of sequentially stackable pieces, tethered together by a string connected at one end to the top piece and running loosely through the other pieces in sequence and then through a hollow base. A plunger mounted on the base is depressable from outside of the base to move a lever, mounted in the base, upwardly under the bottommost piece to topple the stack.

BRIEF DESCRIPTION OF THE DRAWING

For a better understanding of the present invention reference may be had to the accompanying drawing in which.

DETAILED DESCRIPTION OF THE PREFERRED EMBODIMENT

Figure 1:
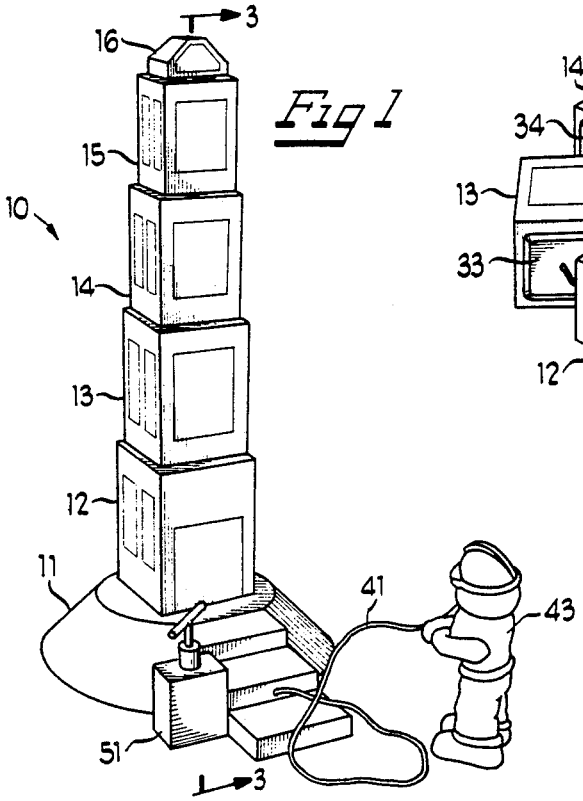
FIG. 1 is a perspective view of one embodiment of the present invention in the stacked condition.

Referring now to the drawing in which like parts are designated by like reference characters throughout the several views, there is shown in FIG. 1 a playset 10 that includes a hollow base 11 upon which pieces 12, 13, 14, 15, and 16 of decreasing size are stackable.

The top of base 11 has a generally central depression 21. Similarly, the top of each of blocks 12–15 has a depression 22, 23, 24, and 25, respectively. On the bottom of block 12, opposite the depression 22, there is a depending projection 32 that fits into the depression 21 on the base 11 to position the piece 12. Each of the pieces 13–16 has a depending projection 33–36, respectively, that mates with the depression in the top of the underlying piece. In the center of the depression 21, there is an aperture 39. There is also an aperture 39 extending through the bottom and top of each of pieces 12–15 plus the bottom of top piece 16. When the pieces are stacked with the depending projection of each fitting into the mating depression in the underlying piece, all of the apertures 39 are substantially aligned.

A tether string 41 is connected at one end to the top piece 16. The cross sectional size of the tether string 41 is such that the string passes freely through the apertures 39. However, knot 42 in the end of the string prevents the string from being pulled through the aperture 39 in the bottom wall of the top piece 16. At the opposite or free end, the string 41 passes through another aperture 39 out of the base and is connected to a tab 43 conveniently formed in the shape of a construction worker. Thus, by grasping the construction worker 43 and pulling the tether string 41, the various pieces 12–16 will be stacked upon the base and then in turn upon each other in the sequence illustrated in FIGS. 1 and 3 to assemble a skyscraper or tower atop the base 11.

Figure 2:
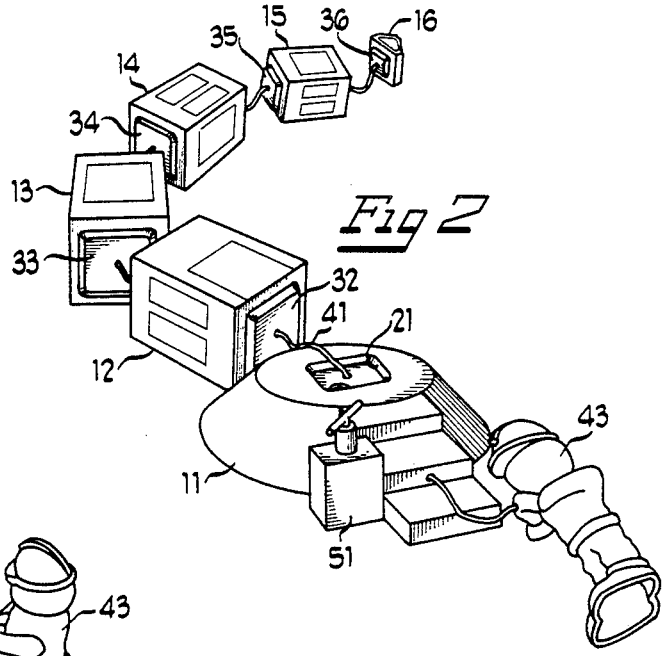
FIG. 2 is a perspective view in the toppled condition.
Figure 3:
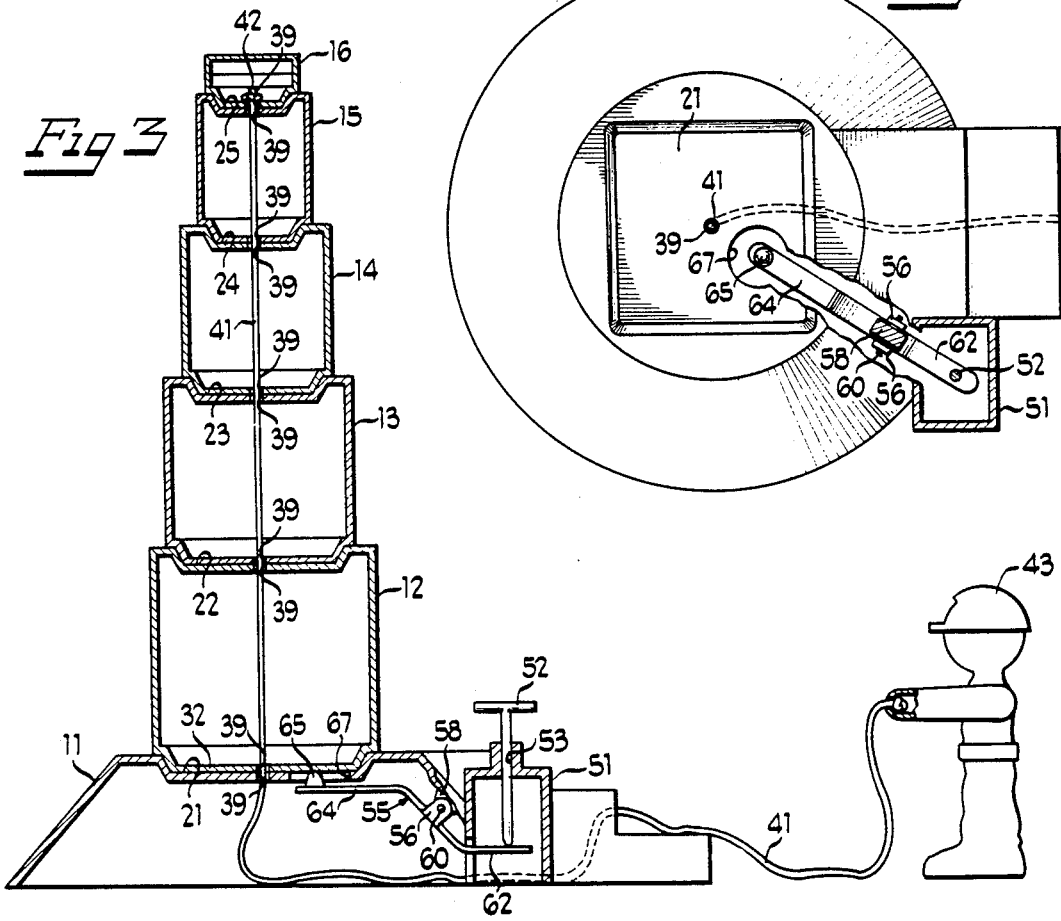
FIG. 3 is an enlarged scale, sectional view taken generally along the line 3—3 of FIG. 1.
Figure 4:
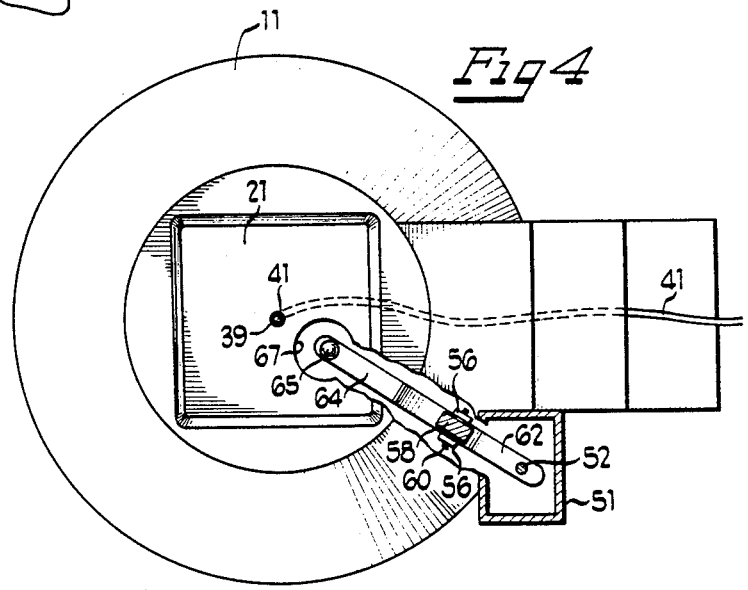
FIG. 4 is an enlarged scale, partially broken away, and partially sectional, top plan view of the hollow base.

Attached to, or integrally formed with, the base 11 is a simulated detonator box 51. A "T" shaped plunger handle 52 fits through a hole 53 in the top of the detonator box permitting up and down movement of the plunger handle. First class lever 55 is mounted under the hollow base for pivotal movement. The lever may be conveniently formed as a metal stamping with tabs 56 bent upwardly to form a yoke for pivotally mounting the lever on a boss 58 projecting downwardly from the underside of the base 11. Fulcrum pin 60 passes through the tabs 56 and the boss 58. Effort arm 62 of the lever extends into the detonator box 51 with the plunger 52 resting atop the arm 62 adjacent the end of the arm. The load arm 64 of the lever is provided with an upwardly projecting finger 65 that passes through an opening 67 in the top of the base with the tip of finger 65 being in contact with the bottom of the projection 32 of piece 12. Thus, when the "T" shaped plunger 52 is pushed downwardly the lever 55, as shown in FIG. 3, will pivot clockwise around the fulcrum pin 60 urging the finger 65 against the bottom of the piece 12 causing the entire tower formed by pieces 12–16 to topple as shown in FIG. 2. If prior to depressing the plunger 52 the entire length of the tether 41 is stretched out, destruction of the tower will also pull down the construction worker tab 43.

While a particular embodiment of the present invention has been shown and described, it will be apparent to those skilled in the art that changes and modifications may be made without departing from the true spirit and scope of the present invention. It is intended in the following claims to cover all such changes and modifications.

What is claimed as new and desired to be secured by Letters Patent is:

1. A playset comprising:

a hollow base;

a plurality of pieces each having at least two opposed surfaces;

an end piece;

a flexible tether of a predetermined length;

one end of the tether secured to the end piece;

the tether passing through the opposed surface of the plurality of pieces and being movable with respect to the pieces;

the portion of the tether remaining after passing through the opposed surfaces of the plurality of pieces passing through the base such that pulling upon the other free end of the tether stacks the pieces upon the base in a predetermined order;

a first class lever mounted at least partially within the base;

an opening in the base permitting engagement of a load arm of the lever with one of the opposed sides of the piece adjacent the base in the predetermined order; and means outside the base permitting exertion of a force on an effort arm of the lever to topple the stacked pieces.

2. The playset of claim 1 in which the base, pieces, and means are thematically related and the other free end of the tether is attached to a tab that is also thematically related.

3. The playset of claim 1 in which:

one of the opposed sides is formed as an inward depression;

the other of the opposed sides is formed as an outward projection; and the inward depression and outward projection of adjacent tethered pieces mate.

4. The playset of claim 1 in which the pieces stack to form a tower and the means is a simulated detonator with a downwardly depressable handle.

* * * * *